US007980678B2

(12) United States Patent
Fukushima et al.

(10) Patent No.: US 7,980,678 B2
(45) Date of Patent: Jul. 19, 2011

(54) INK JET RECORDING HEAD

(75) Inventors: Takashi Fukushima, Yokohama (JP); Toshihiko Ujita, Yokohama (JP); Akihiko Shimomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 12/274,838

(22) Filed: Nov. 20, 2008

(65) Prior Publication Data

US 2009/0141080 A1 Jun. 4, 2009

(30) Foreign Application Priority Data

Dec. 4, 2007 (JP) ..... 2007-313294

(51) Int. Cl.
*B41J 2/05* (2006.01)

(52) U.S. Cl. ..... 347/65

(58) Field of Classification Search ..... 347/40, 347/43, 64, 65, 70, 71; 216/27; 29/890.1; 438/21

See application file for complete search history.

(56) References Cited

U.S. PATENT DOCUMENTS 6,592,202 B2 7/2003 Udagawa et al.
6,908,563 B2 * 6/2005 Tokunaga ..... 216/27
6,966,635 B2 * 11/2005 Miyata et al. ..... 347/70
2007/0139467 A1 6/2007 Kihara et al.
2008/0291234 A1 11/2008 Shimomura et al.
2009/0141085 A1 6/2009 Kihara et al.

* cited by examiner

*Primary Examiner* — Lamson D Nguyen
(74) *Attorney, Agent, or Firm* — Fitzpatrick, Cella, Harper & Scinto

(57) ABSTRACT

An ink jet recording head includes a substrate including a discharge port forming member provided with discharge ports for discharging ink, and a flow path forming member for forming an ink flow path communicating with the discharge ports, wherein at least one of the flow path forming member and the discharge port forming member contains a material having fluorine atoms, a supply path used to supply ink to a supply hole, a support member supporting the substrate, a supply path forming member for forming a part of the supply path, and a rubber member provided between the support member and the supply path forming member and forming a part of the supply path. The supply path forming member or the rubber member contains a material containing bivalent metal, and the rubber member contains a compound providing counter ions to the bivalent metal.

10 Claims, 4 Drawing Sheets

INK JET RECORDING HEAD

BACKGROUND OF THE INVENTION

1. Field of the Invention

The present invention relates to an ink jet recording head for use with an ink jet recording system.

2. Description of the Related Art

An ink jet recording head (hereinafter abbreviated as a recording head) has a substrate including at least a plurality of discharge ports through which ink is discharged, flow paths communicating with respective discharge ports, supply holes through which ink is supplied to the flow paths, and energy generating elements for providing discharge energy to the ink in the flow paths. The ink jet recording head further has a support member for supporting the substrate and an ink supply path forming member for supplying ink to the substrate. The substrate is typically made of silicon (Si). The ink supply path forming member is made of, for example, plastics. A flow path forming member for forming the flow paths is made of, for example, a photosensitive resin, particularly a cationically polymerizable resin and a photopolymerization catalyst. The photopolymerization catalyst may include, for example, a photo-acid-generating agent containing fluorine atoms, such as iodinium salts of antimony fluoride, sulfonium salts of antimony fluoride, or sulfonium salts of phosphorus fluoride, from the standpoint of photoreactivity.

U.S. Pat. No. 6,592,202 discloses a recording head provided with a rubber member as a part of an ink flow path between a support member supporting a substrate and a supply path. The rubber member used herein is a crosslinked rubber which is crosslinked by a metal oxide such as ZnO or MgO, for example, a butyl rubber or a halogenated butyl rubber.

In the recording head disclosed in this publication, a flow path forming member may contain fluorine atoms caused by a photo-acid-generating agent and an ink supply path forming member or the rubber member may contain metal. For example, the ink supply path forming member may contain a filler component including divalent metal for improvement of its strength and heat resistance or a resin modifier containing bivalent metal for improvement of moldability of resin. In addition, in many cases, the ink supply path forming member uses a butyl rubber or a halogenated butyl rubber having high gas barrier property, or alternatively, bivalent metal salts as a crosslinking agent of a butyl rubber. In addition, in many cases, the rubber member is mixed with a filler containing bivalent metal so as to adjust its strength and cut down costs by reducing its resin component.

In such a case, it may be contemplated that a small quantity of metal as a crosslinking component contained in the ink supply path forming member or the rubber member is eluted into ink. It is believed that this metal reacts with fluorine supplied from the flow path forming member to produce a precipitate. Such a precipitate may cause discharge fault by clogging the discharge ports or staying near the discharge ports.

SUMMARY OF THE INVENTION

The present invention has been made to overcome the above problem. It is an object of the invention to provide an ink jet recording head which is capable of discharging ink more effectively in case where a flow path forming member contains fluorine atoms. In particular, it is an object of the invention to provide an ink jet recording head which is capable of suppressing a precipitate caused by components of a rubber member.

According to an aspect of the invention, there is provided an ink jet recording head including: a discharge port forming member provided with discharge ports for discharging ink; a flow path forming member for forming an ink flow path communicating with the discharge ports; and a rubber member for forming a part of an ink path communicating with the ink flow path. At least one of the flow path forming member and the discharge port forming member contains a material having fluorine atoms. The rubber member contains a compound providing counter ions to bivalent metal.

According to the present invention, it is possible to provide an ink jet recording head which is capable of discharging ink more effectively.

Further features of the present invention will become apparent from the following description of exemplary embodiments with reference to the attached drawings.

DESCRIPTION OF THE EMBODIMENTS

Figure 1:
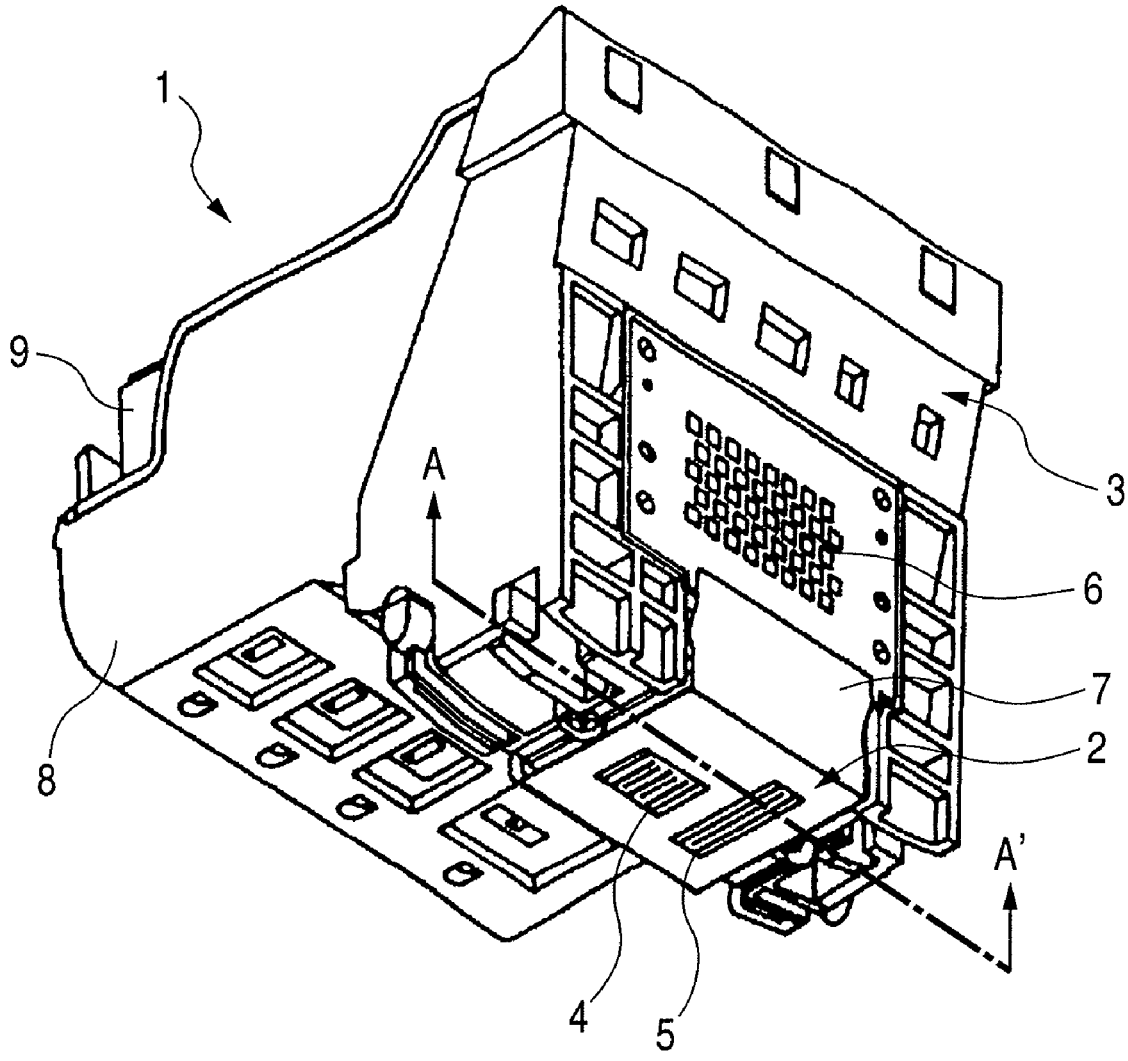
FIG. 1 is a schematic perspective view illustrating an example of an ink jet recording head according to an embodiment of the present invention.

Preferred embodiments of the present invention will now be described in detail in accordance with the accompanying drawings.

In the following description, components having the same function are denoted by the same reference numeral, description of which may be omitted.

An ink jet recording head (recording head) may be equipped in apparatuses such as a printer, a facsimile machine with a communication system, a word processor with a printer, or any industrial recording apparatus compositively combined with various processing devices. The recording head can be used for printing information on various kinds of recording media such as paper, thread, fiber, linen, leather, metal, plastics, glass, wood, or ceramics. "Recording" used herein refers to not only forming an image having a meaning on a recording medium, such as characters or figures, but also forming an image having no meaning, such as patterns.

"Ink" should be broadly interpreted to refer to liquid provided for formation of an image, a form, a pattern or the like, machining of a recording medium, or processing of ink or a recording medium when the ink is applied to the recording medium. Here, the processing of ink or a recording medium refers to improvement of fixation by solidification or insolubility of colorant in ink applied to a recording medium, improvement of recording quality or chromogenic property, and improvement of image durability, for example.

FIG. 1 is a schematic perspective view illustrating an example of an ink jet recording head according to an embodiment of the present invention. A head illustrated in this figure includes recording head parts each including a recording element substrate 4 for three colors of cyan (C), magenta (M) and yellow (Y) and a recording element substrate 5 for black (Bk), as a recording unit 2. The recording head further includes an electrical connector 6 electrically connected to an electrical connector of a recording apparatus when the recording head is equipped in the recording apparatus, and a flexible wiring board 7 for electrically interconnecting the electrical connector 6 and contact pads (not shown) of the two recording head part. An ink supply unit 3 includes a holder 8 for holding separate four color (C, M, Y and Bk) ink tanks 9 and an ink supply path for supplying ink to a row of discharge ports from the respective ink tanks 9.

Figure 2:
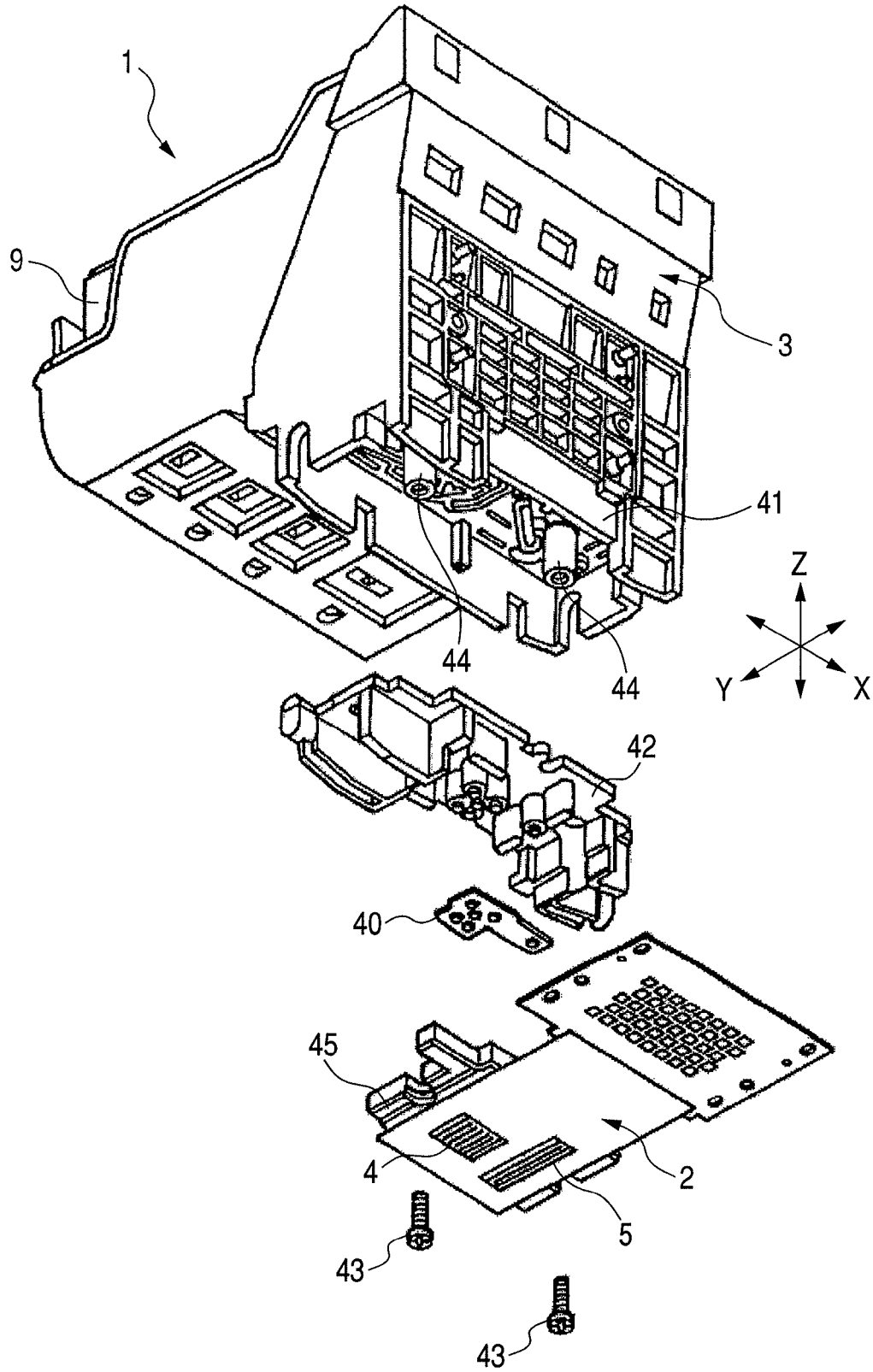
FIG. 2 is a schematic perspective view illustrating an example of an ink jet recording head according to an embodiment of the present invention.

FIG. 2 is an exploded view illustrating parts of the ink jet recording head illustrated in FIG. 1. The recording head includes the recording unit 2, a joint rubber 40, an ink supply path forming member 42 and an ink supply unit 3. An ink supply path 70 (FIG. 3) is formed by welding an ink supply portion 41 of the ink supply unit and the ink supply path forming member 42 together using an ultrasonic wave or the like and bonding the joint rubber 40 and a support member 45 together. The ink supply path 70 is a part of an ink flow path from an ink receiving member to a flow path. The joint rubber 40 is one of rubber members used for the recording head and is provided between the ink supply member 42 and the support member 45, which will be described later. The recording unit 2 and the ink supply unit 3 are together combined by fixing screws 43 to a screw boss 44 in the ink supply portion 41 with the ink supply path forming member 42 and the joint rubber 40 interposed therebetween. This prevents a stripping stress from being applied to a contact portion between the ink supply portion 41 and the ink supply path forming member 42 and the screws 43 used facilitate dissemblance for recycle. At the same time, the recording unit 2 is precisely positioned and fixed with respect to a reference position in X, Y and Z directions of the ink supply unit 3. In addition, the recording element substrates 4 and 5 are fixed to the respective support members 45.

Figure 3:
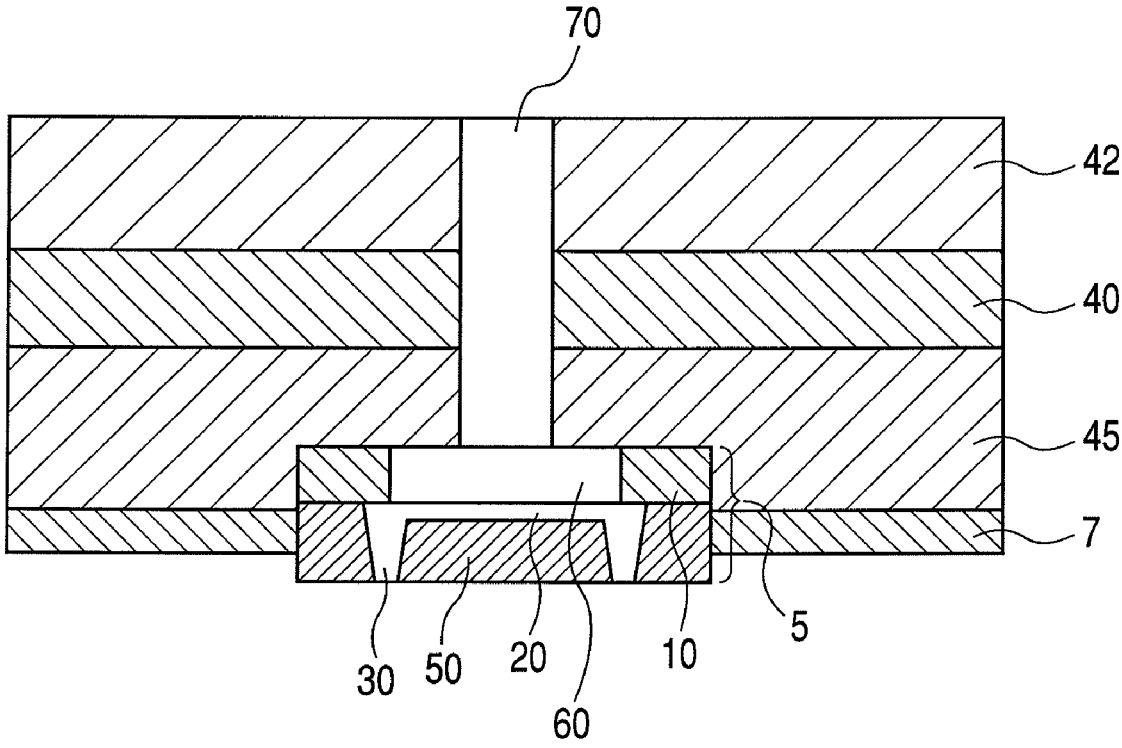
FIG. 3 is a schematic perspective view illustrating an example of an ink jet recording head according to an embodiment of the present invention.

FIG. 3 is schematic sectional view taken along line A-A' in FIG. 1 in a direction perpendicular to the recording element substrates. Ink flows from the ink tanks, through the ink supply portion 41 and the ink supply path 70 provided in the ink supply path forming member 42, the joint rubber 40 and the support member 45, to the discharge ports of the recording element substrate 5. The ink supply path forming member 42 may be integrated with the ink tanks.

The recording element substrate 5 includes a substrate 10 and a discharge port forming member 50 provided on the substrate 10 for forming a flow path 20 and a discharge port 30. In this example, although the flow path 20 and the discharge port 30 are shown to be integrally formed, a flow path forming member for the flow path 20 may be formed separately from the discharge port forming member 30. The substrate 10 becomes a part of a member constituting the flow path. The substrate 10 is not particularly limited in its shape and material as long as it can function as a member for forming a flow path and discharge ports and a support of a nozzle plate.

On this substrate are disposed the desired number of liquid discharge energy generating elements (not shown) such as electro-thermal conversion elements or piezoelectric elements in correspondence to the discharge ports 30. These liquid discharge energy generating elements generate discharge energy for discharging ink. A recording operation is performed when ink is discharged from the discharge ports. As shown in FIG. 3, on the substrate 10 is formed a supply hole 60 for supply of ink through which ink is supplied from an ink supply portion into an ink flow path. The supply hole 60 may be formed using any unit as long as it can form holes in the substrate 10. For example, the supply hole 60 may be formed using either a mechanical unit such as a drill or photo energy of a laser. In addition, a resist pattern may be formed on the substrate 10 and the substrate 10 may be chemically etched using the resist pattern as a mask.

A method of forming the discharge port forming member and the flow path forming member on the substrate is not particularly limited.

Next, material for members used for the ink jet recording head according to an embodiment of the present invention will be described.

(Joint Rubber)

The joint rubber as an example of rubber members applicable to the present invention includes a crosslinked rubber and a compound providing counter ions of bivalent metal. When the joint rubber in contact with ink is placed under a high-temperature environment, the counter ions of the bivalent metal are bled-out from the joint rubber and are eluted into ink. In the present invention, the counter ions reacting with the bivalent metal are actively compounded to be eluted into ink. This supplements the bivalent metal eluted in ink and reduces bivalent metal fluoride, which is produced in the discharge ports, under an environment where bivalent metal does not react with fluorine ions.

A rubber used is not particularly limited as long as it is crosslinked by a crosslinking agent. Specifically, the rubber may preferably be at least one selected from a group including butyl rubber, butyl bromide rubber, butyl chloride rubber, nitrile rubber (NBR), hydrogen-added nitrile rubber (H-NBR) and EPDM rubber. By using these rubbers, it is possible to provide a seal member having high ink resistance and high bondability of the substrate and the ink supply portion.

More specifically, examples of the nitrile rubber may include butadiene-acrylnitrile copolymer rubber, isoprene-butadiene-acrylonitrile copolymer rubber and butadiene-methylacrylate-acrylonitrile copolymer rubber.

Examples of the hydrogen-added nitrile rubber may include hydrogenated butadiene-acrylonitrile copolymer rubber, hydrogenated isoprene-butadiene-acrylonitrile copolymer rubber and hydrogenated butadiene-acrylic acid-acrylonitrile copolymer rubber. These rubbers may be prepared by a typical polymerization and a typical hydrogenation.

Examples of the crosslinking agent for crosslinking rubber may include benzoyl peroxide, t-butylperoxybenzoate, 1,1-bis(t-butylperoxy)cyclododecane, n-butyl-4,4-bis-t-butylperoxyvalerate, t-butylperoxycumendicumylperoxide, di-t-butylperoxide, α, α'-bis(t-butylperoxy-m-isopropyl) benzene, dicumylperoxide, t-butylcumylperoxide, 2,5-dimethyl-2,5-di(t-butylperoxy)hexane and peroxide such as 2,5-dimetyl-2,5-di(t-butylperoxy)hexane-3,1,1-di-t-butylperoxy-3,5,5-trimethylcyclohexane.The crosslinking agent may be used alone or a combination of two or more among the above compounds.

Examples of the compound providing the counter ions of the bivalent metal may include halogen compounds such as polybrominated isoprene, polychlorinated isoprene, polychlorinated ethylene, polybrominated ethylene, 2-chloropolybutadiene and 2-bromopolybutadiene. These compounds can provide bromine ions and chloride ions.

Further, examples of the compound providing the counter ions of the bivalent metal may include sulphur compounds such as 2-mercapto benz imidazole, 2-mercapto methyl imidazole, 2-mercapto benz imidazole, diphenylguadinine, dimethylcarbamic acid, dibenzotiadyldisulfide, amino acids such as citric acid, citric acid salt, EDTA (ethylene diamine tetra acetic acid salt), malic acid, succinic acid, oxalic acid and glycine, and chelate compounds such as gelatin, polyvinylalcohol, diethylenetriamine, iminodiacetic acid, methionine, imidazole, monoethanol amine, diethanol amine and triethanol amine. However, the compound is an example of a compound providing counter ions to bivalent metal, and compounds other than these compounds may be applied to the present invention.

In addition, the joint rubber may be mixed with various compounding agents, which are commonly used in the rubber industries, including a reinforcing agent such as carbon black and silica, a filler such as calcium carbonate and talc, a plasticizer, an acid acceptor, a co-crosslinking agent, a vulcanization accelerator, a processing aid, a stabilizer, an antioxidant agent and a coloring agent, depending on use purpose.

The rubber member may preferably contain no or little fluorine-containing compound. This is because fluorine produced from the rubber member may react with the bivalent metal to produce a precipitate. The rubber member may contain a fluorine-containing compound so as not to react with the bivalent metal.

(Supply Path Forming Member)

The supply path forming member 42 is preferably formed of modified polyphenylene ether (PPE). The modified PPE is preferred from the standpoint of strength and heat resistance. In addition to the modified PPE, material for the supply path forming member 42 may include PPE, PBT, PS, PPS, etc. The supply path forming member 42 may be increased in its heat resistance and strength by being mixed with an inorganic filler such as mica, talc, calcium carbonate, glass, clay, silica. In addition, the supply path forming member 42 may be improved in its moldability by being mixed with a resin modifier such as fatty acid, metal salt thereof, paraffin, wax. The supply path forming member may be formed by combining a plurality of plastic members.

The supply path forming member or the joint rubber is mixed with the bivalent metal so as to obtain a matter property required for the ink jet recording head. For example, the supply path forming member may be mixed with a filler component containing the bivalent metal for the purpose of improvement of its strength and heat resistance or a resin modifier containing the bivalent metal for the purpose of improvement of resin moldability. In addition, the joint member may be a butyl rubber or a halogenated butyl rubber having excellent gas barrier property in many cases. Bivalent metal salts such as MgO or ZnO may be used as a crosslinking agent for the butyl rubber. In addition, in many cases, the joint rubber may be mixed with a filler containing bivalent metal so as to adjust its strength or prevent costs from rising by reducing a resin component. Examples of the bivalent metal may generally include Ca, Mg and Zn.

(Support Member)

Material for the support member is not particularly limited, but may preferably have a certain mechanical strength and high bondability to the substrate having the discharge ports. Examples of the material for the support member may include glass, alumina, ceramics, plastics or metal.

(Discharge Port Forming Member and Flow Path Forming Member)

In the present invention, the discharge port forming member or the flow path forming member is preferably made of cation polymerizable resin. Since the cation polymerizable resin has high crosslinking density (high Tg) as compared to a typical acid anhydride or an amine cured product, it exhibits an excellent characteristic as a structural member of the nozzle plate. In particular, cation photopolymerizable resin is preferred from the standpoint of excellent patterning ability.

The cation photopolymerizable resin is not particularly limited as long as its group can be cation-polymerized by ultraviolet irradiation or the like. Examples of the cation polymerizable group may include a vinyl group, a ring-shaped ether group, particularly an epoxy group and an oxetane group.

Examples of the epoxy resin may include bisphenol type epoxy resin containing a monomer or an oligomer having a bisphenol skeleton, such as a bisphenol-A-diglycidylether and bisphenol-F-diglycidylether, phenol novolak type epoxy resin, cresol novolak type epoxy resin, trisphenolmethane type epoxy resin and 3,4-epoxycyclohexenylmethyl-3',4'-epoxycyclohexenecarboxylate.

In addition, resin having an epoxy group in a side chain of an alicyclic skeleton, which is expressed by the following chemical formula [1], can be appropriately used.

[Chemical Formula 1]

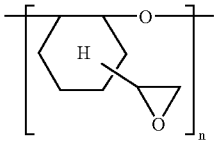

Where, n is an integer.

In addition, novolak resin having a bisphenol A skeleton, which is expressed by the following chemical formula [2], can be appropriately used. n in the chemical formula [2] is preferably an integer of 1 to 3, more preferably 2.

[Chemical Formula 2]

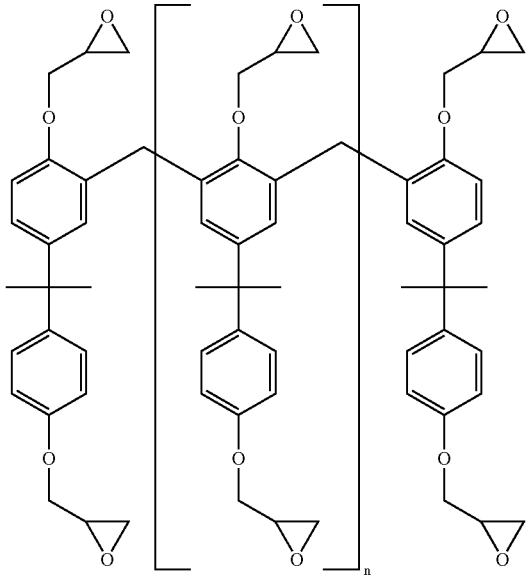

Examples of the resin containing the oxetane compound may include a phenol novolak type oxetane compound, cresol novolak type oxetane compound, trisphenolmethane type oxetane compound, bisphenol type oxetane compound and biphenol type oxetane compound.

These cation polymerizable resins may be used alone or in a combination of a plurality of kinds without degrading effects of the invention.

Additives may be properly added to these cation polymerizable resins as necessary. For example, as additives, a plasticizer may be added for the purpose of lowering elasticity of a cured product or a silane coupling agent may be added for the purpose of further increasing an adhesion with the substrate. In addition, a sensitizer may be added for the purpose of increasing light absorptiveness.

Now, a curing agent of the above-described cation polymerizable resin will be described.

(Curing Catalyst)

A curing catalyst of the present invention initiates cation polymerization by ultraviolet irradiation or the like and can appropriately use a photo-acid-generating agent containing anions including fluorine atoms. The photo-acid-generating agent generally includes cations and anions. With untraviolet irradiation or the like, the cations absorb ultraviolet rays and accordingly acid is separated from the anions. The separated acid acts on a cation polymerizable group to enable effective cation polymerization.

In the photo-acid-generating agent of the present invention, the anions are desired to include fluorine atoms, have high reactivity, and enable effective cation polymerization. Such a catalyst can perform chain propagation reaction and perform polymerization of cation polymerizable resin and crosslinking curing with high crosslinking density at a relatively low temperature in a short time when a reaction starts. In addition, it is possible to obtain high mechanical strength required for the members for forming the discharge ports and the flow path of the ink jet recording head.

Such a catalyst may use those known in the art. Examples of such a catalyst may include $BF_4^-$, $B(C_6F_5)_4^-$, $PF_6^-$, $AsF_6^-$, $SbF_6^-$, $CF_3SO_3^-$salts of aromatic onium compounds such as diazonium, ammonium, iodonium, sulfonium, phosphonium.

Specifically, iodonium salts such as diphenyliodoniumtrifluoromethylsulfone salts expressed by the following chemical formula [3] can be used as the photo-acid-generating agent.

[Chemical Formula 3]

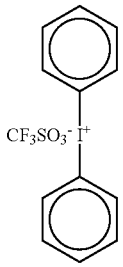

In addition, sulfonium salts such as triphenylsulfoniumhexafluoroantimonate salts expressed by the following chemical formula [4] can be used as the photo-acid-generating agent.

[Chemical Formula 4]

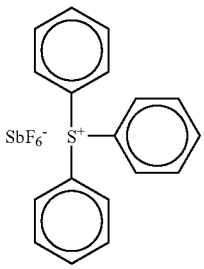

In addition, other examples of the photo-acid-generating agents may include N-hydroxynaphthalimide-trifluoromethanesulfonate, N-hydroxyphthalimide-trifluoromethanesulfonate, bis(4-t-butylphenyl)iodonium-trifluoromethanesulfonate, triphenylsulfonium-trifluoromethanesulfonate, tris(4-t-butylphenyl)sulfonium-trifluoromethanesulfonate, triphenylsulfonium-trifluoromethanesulfonate, tris(4-t-butylphenyl) sulfonium-hexafluoroantimonate and tris(4-t-butylphenyl)sulfonium-tetrafluoroantimonate.

Such photo-acid-generating agents may be UV16976 (available from DOW CHEM CO.) or SP-172, SP-170, SP-150 and so on (available from ASAHI DENKA KOGYO K.K.).

Such photo-acid-generating agents may be used alone or in a combination of two or more kinds without departing from the spirit and scope of the invention.

The catalyst may be used together with a reducing agent. The reducing agent can accelerate cation polymerization by heating in addition to the ultraviolet irradiation. That is, this can further improve crosslinking density as compared to the sole use of the catalyst and the ultraviolet irradiation. In addition, in the combined use of the photopolymerization catalyst and the reducing agent, there is a need to select a so-called Redox type reducing agent which reacts at a temperature (preferably more than 60° C.) higher than the normal temperature. A copper compound or an ascorbic acid may be useful for such a reducing agent.

Embodiment 1

In this embodiment, a recording head was prepared according to the following process.

First, a recording element substrate having members for forming a flow path and discharge ports was formed as follows.

Figure 4A:
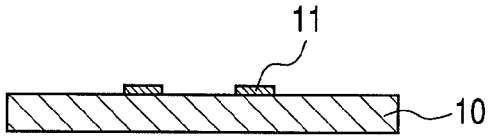
FIGS. 4A, 4B, 4C, 4D, 4E, 4F and 4G are schematic sectional views illustrating an example of some processes in a method of manufacturing an ink jet recording head according to an embodiment of the present invention.

First, a silicon substrate 10 having heaters 11 was prepared (FIG. 4A).

Figure 4B:
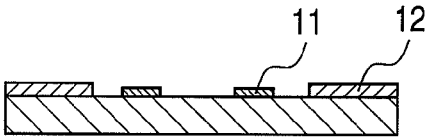

Subsequently, an adhesion layer 12 was formed on the substrate by polyetherimide resin (FIG. 4B).

Figure 4C:
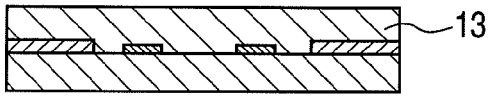

Subsequently, polymethylisoprophenylketone resin 13 was formed on the substrate (FIG. 4C).

Figure 4D:
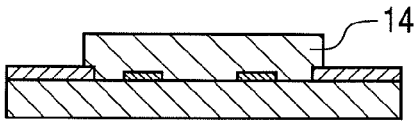

Subsequently, the polymethylisoprophenylketone resin 13 was patterned to prepare a pattern 14 corresponding to a portion which becomes an ink flow path (FIG. 4D).

Figure 4E:
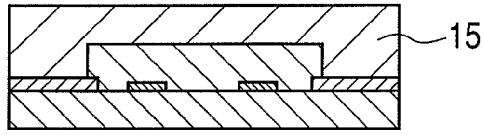

Subsequently, a solution obtained by dissolving composition 1 shown in Table 1 into xylene (a ratio of xylene to composition 1=1:1) was spin-coated on the substrate. Thereafter, a coating layer 15 was formed by heating and drying the spin-coated solution at 60° C. for 9 minutes (FIG. 4E). The catalyst shown in Table 1 contains fluorine atoms.

TABLE 1

| Material | Product Name [Manufacturer] | Contents (wt %) |
|---|---|---|
| Epoxy resin | EHPE-3150 [Diacel Chemical Industries, Ltd.] | 93 |
| Catalyst | SP-170 [Asahi Denka Kogyo K.K.] | 2 |
| Silane Coupling Agent | A-187 [Nippon Unicar Company Ltd.] | 5 |

Figure 4F:
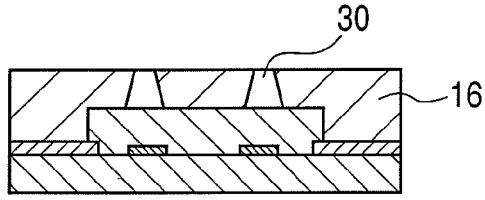

Subsequently, the silicon substrate formed thereon with the coating layer 15 was exposed for 5 seconds through a mask of patterns of the ink discharge ports using a mask aligner MPA600 (product name) (available from CANON Inc.). Thereafter, the substrate was baked at 90° C. for 3 minutes and then was cured through cation polymerization reaction of cation polymerizable resin. In this manner, a discharge port forming member 16 for forming the discharge ports 30 was prepared (FIG. 4F).

Figure 4G:
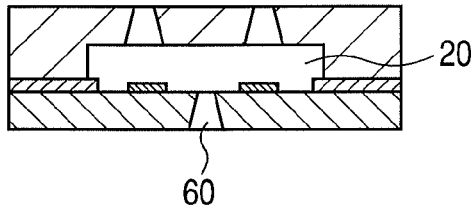

Subsequently, the pattern 14 was removed by using a solvent to form the flow path 20 (FIG. 4G). A wall member of the flow path 20 was formed from composition 1 in the same way as the discharge port forming member 16.

Finally, the supply hole 60 was formed in the substrate 10 (FIG. 4G). The recording element substrate attained so was bonded to the support member 45 made of ceramics. Thereafter, the support member 45 was stuck on the ink supply path forming member 42 made of thermoplastic resin via the joint rubber 40, a required electrical connection was made, and ink was filled to complete the ink jet recording head shown in FIG. 1.

The joint rubber 40 was made of brominated polyisoprene (Br-IIR) as a compound providing counter ions to bivalent metal in H-NBR as a main polymer. The brominated polyisoprene was adjusted such that the concentration of bromine ions eluted into the ink flow path becomes more than 0.4 ppm by conserving the ink jet recording head at 70° C.

The supply path forming member 42 was formed with a material obtained by mixing stearin salts, as a resin modifier to improve moldability, and a glass filler and mica, as a reinforcing agent, in modified PPE as a main polymer.

It was confirmed through an ionchromatographic apparatus that the concentration of Mg believed to be supplied from the reinforcing agent and the resin modifier becomes 0.4 ppm by conserving the ink jet recording head at 70° C.

Embodiment 2

2-mercaptomethylbenzimidazole (product name: NOCRAC MMB, available from OUCHI SHINKO CHEMICAL INDUSTRIAL CO.,LTD.) was used as a compound providing counter ions to bivalent metal mixed with the material forming the joint rubber 40. The mixuture amount of 2-mercaptomethylbenzimidazole was adjusted such that the concentration of 2-mercaptomethylbenzimidazole eluted into the ink flow path becomes more than 0.4 ppm by conserving the ink jet recording head at 70° C. The remaining configuration was the same as the configuration of Embodiment 1.

Embodiment 3

EDTA (ethylene diamine tetra acetic acid salt) (available from Nagase ChemteX Corporation) was used as a compound providing counter ions to bivalent metal mixed with the material forming the joint rubber 40. The mixuture amount of EDTA was adjusted such that the concentration of EDTA eluted into the ink flow path becomes more than 0.4 ppm by conserving the ink jet recording head at 70° C. The remaining configuration was the same as the configuration of Embodiment 1.

COMPARATIVE EXAMPLE 1

Comparative Example 1 has the same configuration as Embodiment 1 except that a compound providing counter ions of bivalent metal is not mixed with the material forming the joint rubber.

(Evaluation)

The ink jet recording heads of Embodiments 1 to 3 and Comparative Example 1 were checked whether or not a magnesium fluoride precipitate as fluoride of bivalent metal was produced in the discharge ports after the ink jet recording heads were filled with a preservative solution and were conserved at 70° C. Evaluation was made with 6 heads (A to E) as samples in Embodiments 1 to 3 and Comparative Example 1.

Results of the evaluation are shown in Table 2. The manufactured ink jet recording heads enable printing by ink of five colors, with rows of discharge ports formed for each color. The results shown in Table 2 show that a precipitate is produced in several of five rows of the discharge ports.

It can be seen from Table 2 that the ink jet recording heads of Embodiments 1 to 3 have reduced precipitation of magnesium fluoride as compared to the ink jet recording head of Comparative Example 1.

TABLE 2

| | Number of rows in which precipitate is produced | | | | | | Sum of |
|---|---|---|---|---|---|---|---|
| Sample | A | B | C | D | E | F | 6 heads |
| Embodiment 1 | 0 | 0 | 0 | 0 | 0 | 0 | 0 |
| Embodiment 2 | 0 | 0 | 0 | 0 | 0 | 0 | 0 |
| Embodiment 3 | 0 | 0 | 0 | 0 | 0 | 0 | 0 |
| Comparative Example 1 | 1 | 4 | 3 | 3 | 4 | 0 | 15 |

The ink jet recording heads of Embodiments 1 to 3 and Comparative Example 1 were filled with ink (water/glycerine/direct black 154 (water-soluble black dyes)=65/30/5). After the ink jet recording heads were conserved at 70° C. for 24 hours, the ink jet recording heads were equipped in an apparatus and were subjected to an image forming process. The ink jet recording heads of Embodiments 1 to 3 showed good images. On the contrary, the ink jet recording head of Comparative Example 1 showed a poor image having creases. It is believed that the ink jet recording heads of Embodiments 1 to 3 have images superior to that of Comparative Example 1 since the bivalent metal and the compound providing the counter ions in the joint rubber prevent metal fluoride salts from being precipitated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-313294, filed Dec. 4, 2007, which is hereby incorporated by reference herein in its entirety.

What is claimed is:

1. An ink jet recording head comprising:

a substrate having a discharge port forming member provided with discharge ports for discharging ink, and a flow path forming member for forming an ink flow path communicating with the discharge ports, wherein at least one of the flow path forming member and the discharge port forming member contains a material having fluorine atoms;

a supply path which is a part of an ink path communicating with the ink flow path and is used to supply ink to a supply hole;

a support member for forming a part of the supply path and supporting the substrate;

a supply path forming member for forming a part of the supply path; and a rubber member which is provided between the support member and the supply path forming member and forms a part of the supply path, wherein the supply path forming member or the rubber member contains a material containing bivalent metal, and the rubber member contains a compound providing counter ions to the bivalent metal.

2. The ink jet recording head according to claim 1, wherein the material containing the bivalent metal includes Mg.

3. The ink jet recording head according to claim 1, wherein the material containing the bivalent metal includes Zn.

4. The ink jet recording head according to claim 1, wherein the compound is MgO.

5. The ink jet recording head according to claim 1, wherein the compound is ZnO.

6. The ink jet recording head according to claim 1, wherein the rubber member contains an EPDM rubber.

7. The ink jet recording head according to claim 1, wherein the rubber member contains a hydrogenated nitrile rubber.

8. The ink jet recording head according to claim 1, wherein the rubber member does not contain a compound containing fluorine.

9. An ink jet recording head comprising:

a discharge port forming member provided with discharge ports for discharging ink;

a flow path forming member for forming an ink flow path communicating with the discharge ports; and a rubber member for forming a part of an ink path communicating with the ink flow path, wherein at least one of the flow path forming member and the discharge port forming member contains a material having fluorine atoms, and wherein the rubber member contains a compound providing counter ions to bivalent metal.

10. An ink jet recording head comprising:

a substrate having a discharge port forming member provided with discharge ports for discharging ink, and a flow path forming member for forming an ink flow path communicating with the discharge ports, wherein at least one of the flow path forming member and the discharge port forming member contains a material having fluorine atoms;

a supply path which is a part of an ink path communicating with the ink flow path and is used to supply ink to a supply hole;

a support member for forming a part of the supply path and supporting the substrate;

a supply path forming member for forming a part of the supply path; and a rubber member which is provided between the support member and the supply path forming member and forms a part of the supply path, wherein the rubber member contains a compound providing counter ions to bivalent metal.

* * * * *